US005913319A

United States Patent [19]

Tsai

[11] Patent Number: 5,913,319

[45] Date of Patent: Jun. 22, 1999

[54] HAIR BINDER

[76] Inventor: Kai-Mou Tsai, 4/F., No. 1, Lane 135, Tao-Hsiang Rd., Peitou Dist., Taipei City, Taiwan

[21] Appl. No.: 09/174,321

[22] Filed: Oct. 19, 1998

[51] Int. Cl.[6] ..... A45D 2/20

[52] U.S. Cl. ..... 1323/247; 132/273

[58] Field of Search ..... 132/273, 247, 132/275; 63/21; 24/18, 17 B, 122.6, 308, 572, 575, 576, 580, 602

[56] References Cited

U.S. PATENT DOCUMENTS

| | | | |
|---|---|---|---|
| 4,044,725 | 8/1977 | Miller | 24/602 |
| 4,854,335 | 8/1989 | Lycett | 132/247 |
| 5,115,825 | 5/1992 | Kuhn | 132/273 |
| 5,692,528 | 12/1997 | Brenn-Albertoni | 132/247 |

*Primary Examiner*—Todd E. Manahan
*Assistant Examiner*—Eduardo C. Robert
*Attorney, Agent, or Firm*—Rosenberg, Klein & Bilker

[57] ABSTRACT

A hair binder having a cord member and a fastener formed of a male fastening element and a female fastening element respectively fastened to two opposite ends of the cord member for joining the ends of the cord member. The male fastening element has a rounded head with a neck at its front side and a coupling groove or coupling flange around the rounded head and the neck. The female fastening element has a bottom open chamber and a coupling hole for receiving the rounded head and neck of the male fastening element, and a coupling flange or coupling groove for engagement with the coupling groove or coupling flange of the male fastening element to secure the rounded head of the male fastening element to the inside of the female fastening element.

4 Claims, 5 Drawing Sheets

HAIR BINDER

BACKGROUND OF THE INVENTION

The present invention relates to hair binders for arranging the hair, and more particularly to such a hair binder that can conveniently set into the operative condition.

A regular hair binder, as shown in FIG. 1, is comprised of an elastic band 31, and a metal clamp 3 fixedly fastened to the ends of the elastic band 31. Because the metal clamp 3 is fixedly fastened to the elastic band 31, the ends of the elastic band 31 cannot be opened. When in use, the elastic band 31 must be twisted into loops for fastening to the air. Further, because the metal clamp 3 has edges, the user's fingers tend to be injured by the edges of the metal clamp 3 or the hair tends to be damaged by the metal clamp 3 when fastening the elastic band 31 to the hair. FIG. 2 shows a regular necklace which is comprised of a string of beads 53, a swivel male connector 51 with a screw rod 52 at one end of the string of beads 53, and a female connector 5 with a screw hole at an opposite end of the string of beads 53. When in use, the screw rod 52 of the swivel male connector 51 is threaded into the screw hole on the female connector 5. FIG. 3 shows another structure of necklace. This structure of necklace is comprised of a string of beads 63, a link 6 with a knob-controlled tongue 61 at one end of the string of beads 63, and a fixed ring 62 at an opposite end of the string of beads 63. When in use, the knob-controlled tongue 61 is pulled back to open the link 6, enabling the fixed ring 62 to be inserted into the link 6, then the knob-controlled tongue 6 is released from the hand and forced by a spring in the link 6 to close the link 6. In the aforesaid necklaces, the swivel male connector 51, the female connector 5, the link 6 and the fixed ring 62 are made of metal and electroplated with a metal coating. The coating wears quickly with the use of the necklace.

SUMMARY OF THE INVENTION

According to one aspect of the present invention, the hair binder comprises a cord member, male fastening element and a female fastening element at two opposite ends of the cord member for joining the ends of the cord member, wherein the male fastening element has a rounded head with a neck at its front side and a coupling groove (or coupling flange) around the rounded head and the neck, the female fastening element has a bottom open chamber and a coupling hole for receiving the rounded head and neck of the male fastening element, and a coupling flange (or coupling groove) for engagement with the coupling groove (or coupling flange) to secure the rounded head of the male fastening element to the inside of the female fastening element. According to another aspect of the present invention, the male fastening element and the female fastening element are respectively injection-molded from plastics.

DETAILED DESCRIPTION OF THE PREFERRED EMBODIMENTS

Figure 1:
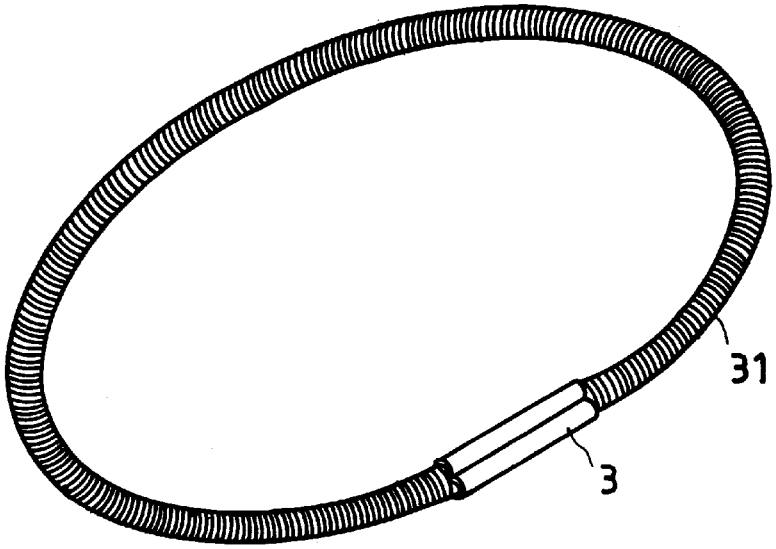
FIG. 1 PRIOR ART
FIG. 1 is a perspective view of a hair binder according to the prior art.

Referring to FIGS. from 4 through 8, a hair binder in accordance with the present invention is generally comprised of a fastener 1, and a cord member 2. The fastener 1 is comprised of a male fastening element 12 fixedly fastened to one end of the cord member 2, and a female fastening element 11 fixedly fastened to the other end of the cord member 2. The male fastening element 12 and the female fastening element 1 are respectively injection-molded from plastics. The male fastening element 12 comprises a neck 122 extended from the front side thereof, a rounded head 121 at the free end of the neck 122, and a coupling groove 123 around the rounded head 121 and the neck 122. The female fastening element 11 comprises a button open chamber 111, a coupling hole 112 longitudinally extended from the bottom open chamber 11 to the back side wall thereof, a coupling flange 113 raised from the inside wall around the bottom open chamber 111 and the coupling hole 112, and a top finger hole 114 at the top side wall thereof in communication with the bottom open chamber 111. The rounded head 121 and neck 122 of the male fastening element 12 are pressed into the bottom open chamber 111 and coupling hole 112 of the female fastening element 11 from the bottom side toward the top side, enabling the coupling groove 123 of the male fastening element 12 to be forced into engagement with the coupling flange 113 of the female fastening element 1, and therefore the hair binder is assembled, i.e., the ends of the cord member 2 are joined by the fastener 1. When not in use, the thumb or one finger is inserted into the top finger hole 114 to impart a downward pressure of the rounded head 121 of the male fastening element 12, causing the rounded head 121 and the neck 122 to be disengaged from the coupling flange 113, and therefore the male fastening element 12 and the female fastening element 11 are disconnected from each other.

Figure 9:
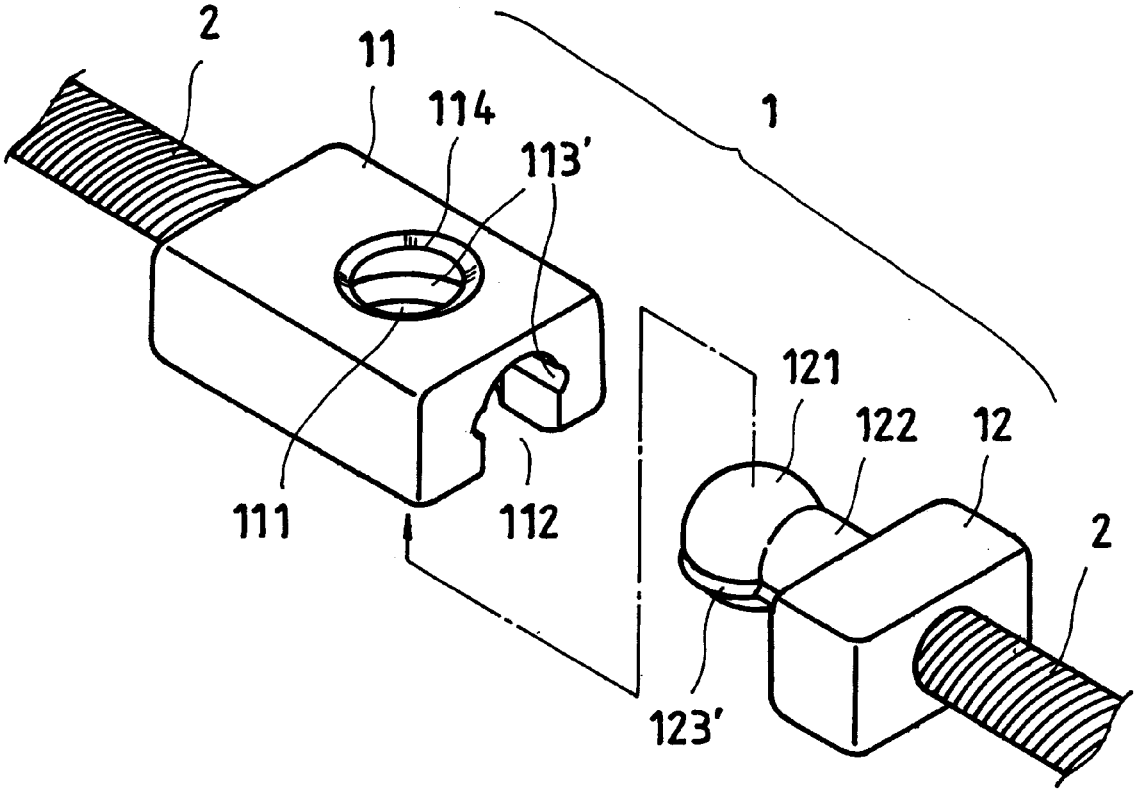
FIG. 9 is a perspective view of an alternate form of the present invention, showing the male fastening element disconnected from the female fastening element.

FIG. 9 shows an alternate form of the present invention. According to this alternate form, a coupling groove 113' is provided inside the bottom open chamber 111 and coupling hole 112 of the female fastening element 11, and the male fastening element 12 comprises a coupling flange 123' raised around the rounded head 121 and the neck 122 for engagement with the coupling groove 113' of the female fastening element 11.

Figure 10:
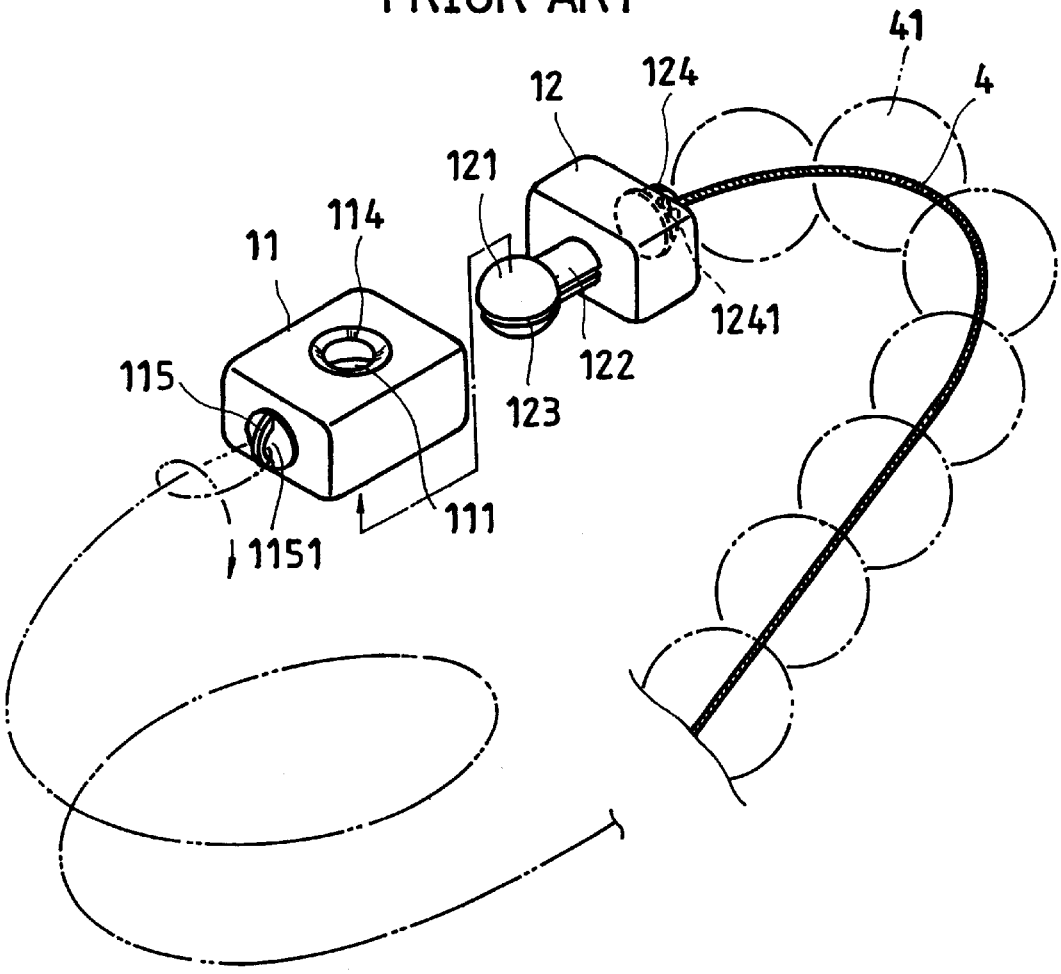
FIG. 10 shows another alternate form of the present invention.
Figure 2:
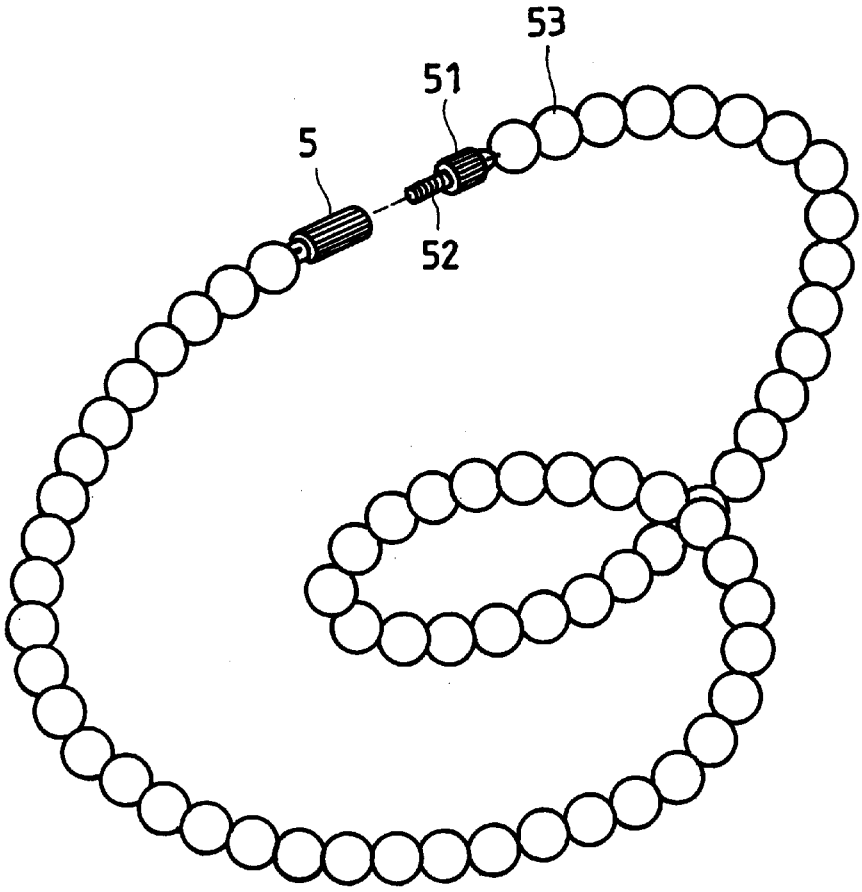
FIG. 2 PRIOR ART
FIG. 2 illustrates a necklace according to the prior art.
Figure 3:
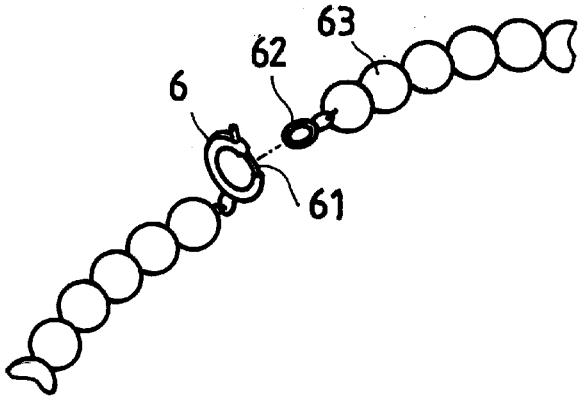
FIG. 3 PRIOR ART
FIG. 3 illustrates another structure of necklace according to the prior art.
Figure 4:
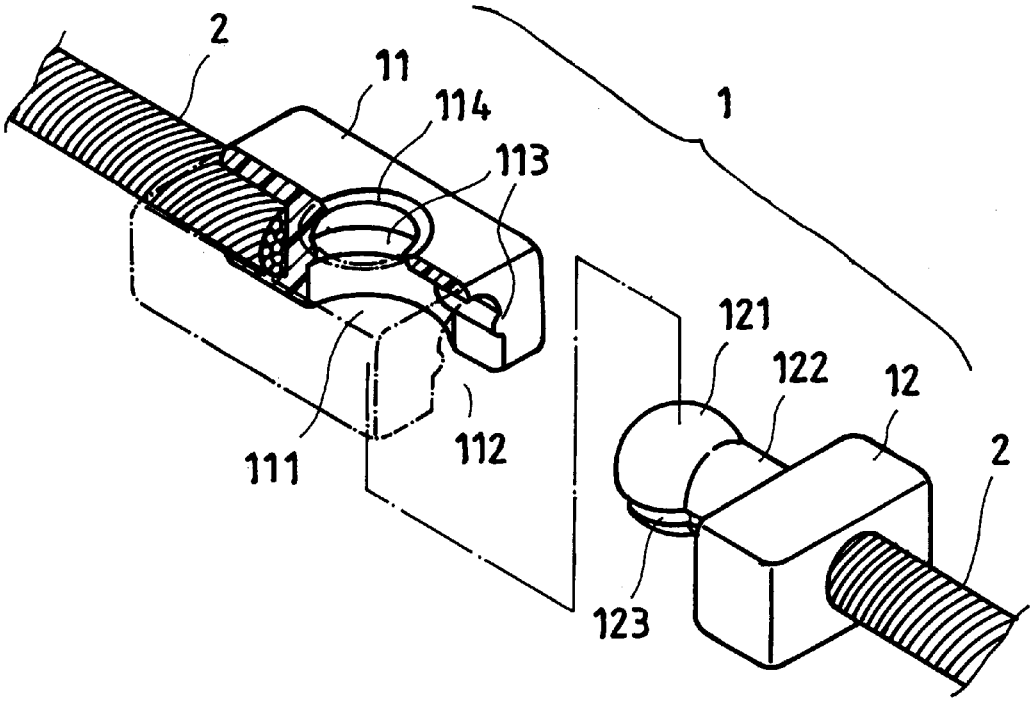
FIG. 4 is a perspective view of a hair binder according to the present invention, showing the male fastening element disconnected from the female fastening element.
Figure 5:
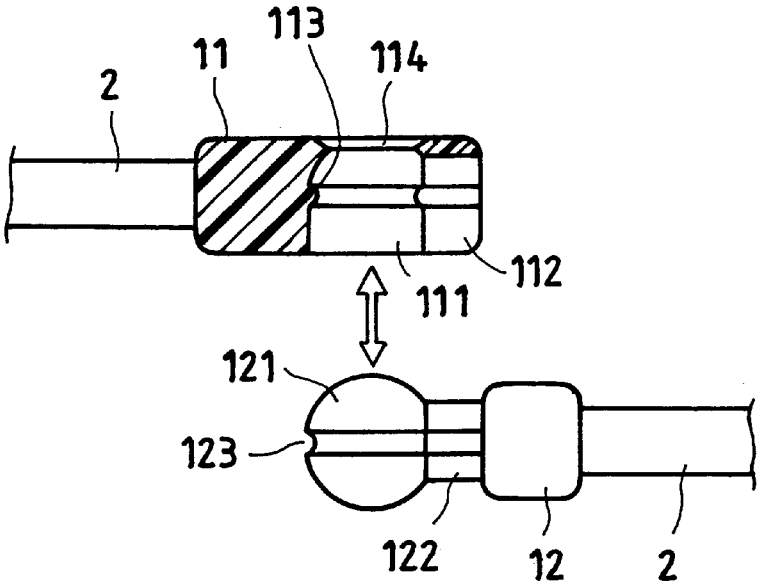
FIG. 5 is a sectional view showing the relationship between the male fastening element and the female fastening element according to the present invention.
Figure 6:
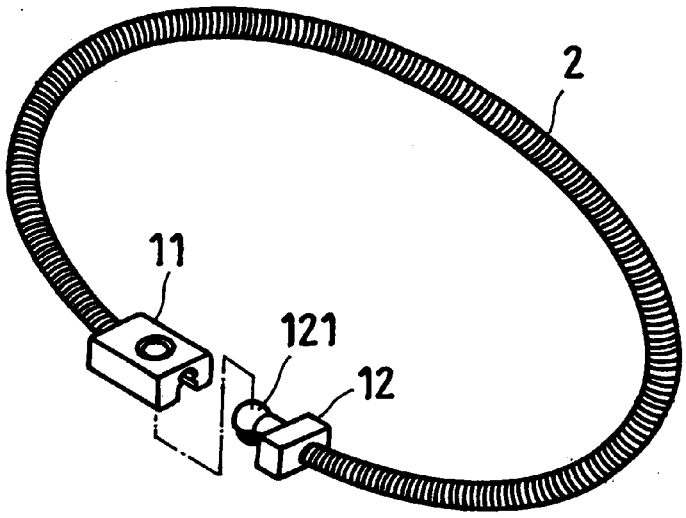
FIG. 6 is a perspective view of the hair binder according to the present invention.
Figure 7:
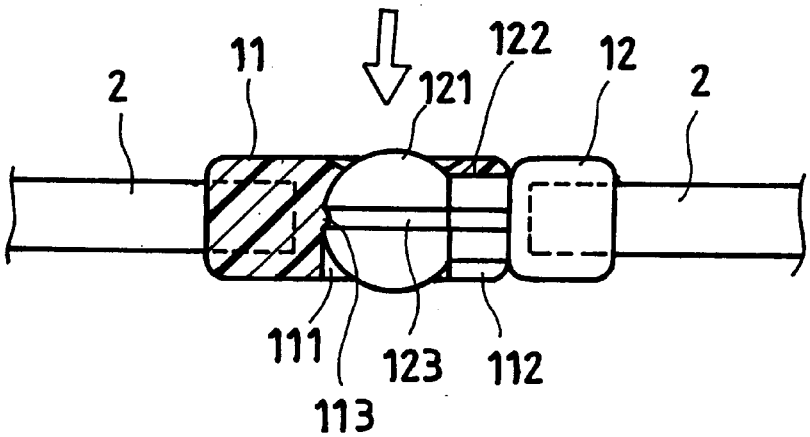
FIG. 7 is a side view in section showing the male fastening element and the female fastening element fastened together.
Figure 8:
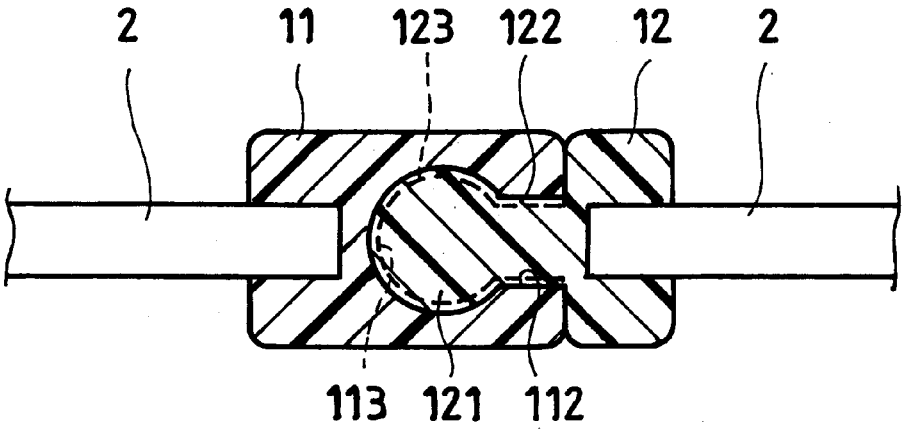
FIG. 8 is a top view in section showing the male fastening element and the female fastening element fastened together.

Referring to FIG. 10, the male fastening element 12 has a lug 124 at its back side, the female fastening element 11 has a lug 115 at its back side, and the ends of the cord member 4 of the string of beads 41 are respectively fastened to the hole 1241, 1151 of the lugs 124. The beads of the string of beads 41 may have different colors.

It is to be understood that the drawings are designed for purposes of illustration only, and are not intended as a definition of the limits and scope of the invention disclosed.

What that invention claimed is:

1. A hair binder comprising a cord member, and a fastener formed of a male fastening element and a female fastening element respectively fastened to two opposite ends of the cord member to fasten the ends of the cord member together, wherein said male fastening element comprises a neck extended from a front side wall thereof and terminating in a rounded head, and a coupling groove around said rounded head and said neck; said female fastening element comprises a bottom open chamber for receiving the rounded head of said male fastening element, a coupling hole longitudinally extended from said bottom open chamber to a back side wall thereof for receiving the neck of said male fastening element, a coupling flange raised from an inside wall thereof around said bottom open chamber and said coupling hole for engagement with the coupling groove of said male fastening element, and a top finger hole at a top side wall thereof in communication with said bottom open chamber for insertion of a finger to push said male fastening element away from the bottom open chamber and coupling hole of said female fastening element.

2. The hair binder of claim 1 wherein said male fastening element and said female fastening element each have a back side wall and an eyed lug at the back side wall for holding the ends of said cord member.

3. A hair binder comprising a cord member, and a fastener formed of a male fastening element and a female fastening element respectively fastened to two opposite ends of the cord member to fasten the ends of the cord member together, wherein said male fastening element comprises a neck extended from a front side wall thereof and terminating in a rounded head, and a coupling flange raised around said rounded head and said neck; said female fastening element comprises a bottom open chamber for receiving the rounded head of said male fastening element, a coupling hole longitudinally extended from said bottom open chamber to a back side wall thereof for receiving the neck of said male fastening element, a coupling groove disposed on the inside around said bottom open chamber and said coupling hole for engagement with the coupling flange of said male fastening element, and a top finger hole at a top side wall thereof in communication with said bottom open chamber for insertion of a finger to push said male fastening element away from the bottom open chamber and coupling hole of said female fastening element.

4. The hair binder of claim 1 wherein said male fastening element and said female fastening element each have a back side wall and an eyed lug at the back side wall for holding the ends of said cord member.

* * * * *